US005163764A

United States Patent [19]

Falconieri et al.

[11] Patent Number: 5,163,764

[45] Date of Patent: Nov. 17, 1992

[54] CARTRIDGE FOR A TYPING RIBBON HAVING A RIBBON TENSIONER

[75] Inventors: Remo Falconieri, S. Giorgio; Sergio Uggetti, Ivrea, both of

[73] Assignee: Ing. C. Olivetti & C. SpA, Ivrea, Italy

[21] Appl. No.: 323,842

[22] Filed: Mar. 15, 1989

[30] Foreign Application Priority Data

Mar. 16, 1988 [IT] Italy ..... 67227 A-88

[51] Int. Cl.[5] ..... B41J 33/52

[52] U.S. Cl. ..... 400/234; 400/208

[58] Field of Search ..... 400/234, 207, 219.1, 400/208, 223

[56] References Cited

U.S. PATENT DOCUMENTS

| | | | |
|---|---|---|---|
| 4,352,578 | 10/1982 | Dunning et al. | 400/207 |
| 4,373,824 | 2/1983 | Olsen | 400/234 |
| 4,533,266 | 8/1985 | Saito et al. | 400/234 |
| 4,602,881 | 7/1986 | Prevignano et al. | 101/93.05 |
| 4,669,902 | 6/1987 | Ukmar et al. | 400/208 |
| 4,710,044 | 12/1987 | Ackermann | 400/234 |
| 4,730,780 | 3/1988 | Shimoyama | 400/234 |
| 4,756,635 | 7/1988 | Frerichs | 400/208 |
| 4,762,434 | 8/1988 | Hirano | 75/354 |
| 4,861,176 | 8/1989 | DeStefano | 400/208 |

*Primary Examiner*—Edgar S. Burr
*Assistant Examiner*—John S. Hilten
*Attorney, Agent, or Firm*—Banner, Birch, McKie & Beckett

[57] ABSTRACT

A cartridge for a typing ribbon for typewriters comprises a container for accommodating a typing ribbon which can be of single-strike correctable or non-correctable, multi-strike or endless inked type. If the ribbon is of the single-strike or multi-strike type, the container comprises a supply reel and a tensioning and stop device co-operating with a toothed flange of the supply reel to prevent the ribbon which is wound on the supply reel from unwinding both when the container is mounted on the machine and when it is removed from the machine. The device comprises a tensioning lever for the ribbon and a stop lever for the reel, which levers are connected together by means of a resilient spring connection. The device guides and tensions the ribbon during the unidirectional feed movement thereof, in such a way as to ensure a constant stepping movement in the feed motion of the ribbon and low and constant tensioning of the ribbon. If the ribbon is of the inked type, the container comprises a magazine for accommodating the ribbon which is disposed in randomly distributed loops, a feed roller which drives in rotation a first feed wheel for producing a feed movement of the ribbon, together with a pressure roller for introduction of the ribbon into the magazine.

15 Claims, 6 Drawing Sheets

CARTRIDGE FOR A TYPING RIBBON HAVING A RIBBON TENSIONER

BACKGROUND OF THE INVENTION (1) Field of the Invention

The present invention relates to a cartridge for a typing ribbon and concerns more particularly a cartridge in which the supply reel has a flange provided with peripheral notches and having a ribbon tensioning lever and stop element engaging with the notches.

(2) Description of the Pior Art

U.S. Pat. No. A 4 810 839 discloses a cartridge for a typing ribbon comprising a container or casing for accommodating a supply reel having a flange provided on the outside edge with a series of peripheral notches and a tensioning and stop device comprising a tensioning lever which is pivoted on a pin on the container. The tensioning lever comprises at one end a pin, the lower part of which is co-operable with the series of peripheral notches on the flange of the supply reel while the upper part thereof guides and tensions the typing ribbon by the action of a spring which is applied to the other end of the lever and which is capable of holding the pin in engagement with the spaces between the series of notches, with the ribbon stationary, and which gives rise to a movement for engagement and disengagement as between the pin and the notches during the feed movement of the ribbon to hold it in a condition of tension in use thereof. The tensioning and stop device is sufficiently operational for typing ribbons which are fairly rigid and robust. On the other hand, since the lever is reasonably long, it is robust but heavy and, for optimum operation, the spring must also provide a fairly high level of tension for tensioning the ribbon. That device is therefore not suited for ribbons which have very thin deformable supports which are required when large amounts of ribbon are to be used in the cartridge.

SUMMARY OF THE INVENTION

The object of the invention is therefore to provide a cartridge for a typing ribbon which is simple, functional, practical, reliable and of limited cost and which also optimises tensioning and controlled movement of ribbons with thin deformable supports.

To this end the cartridge for a typing ribbon according to the invention has stop lever pivoted in the container and carrying a stop element. The stop lever oscillates between an engagement position, in which the stop element engages the notches and locks the reel, and a disengagement position. A spring normally holds the lever in the engagement position. A spring normally holds the lever in the engagement position. A last motion coupling is provided between the two levers. When the ribbon tightens, after an initial movement of the tensioning lever alone, the stop lever also moves, to the disengagement position.

According to another feature of the invention, a bearing element of the tensioning lever cooperates with the stop lever for the disengagement of the stop element.

The ribbon is driven by a roller with a toothed wheel. The ribbon receiving or take-up reel is mounted on a pin on a first arm of a pivoted lever and urged by resilient means against the toothed wheel. The lever has a second arm, at 90° to the first arm. One of the arms is supported on guide means for free translatory movement parallel to the bottom of the container.

A further wheel with sawtooth teeth rotates with the toothed wheel and cooperates with a resilient stop element to prevent reverse rotation of the reel.

The drive roller is driven from a drive shaft of the typewriter through an epicyclic gear, fully described below.

The cartridge is releasably fitted on a support on the typewriter by an improved engagement means.

BRIEF DESCRIPTION OF THE DRAWINGS

The above and other features of the invention will be clear from the following description, which sets forth a preferred embodiment of the invention, which is given by way of non-limiting example, with reference to the accompanying drawings in which.

DESCRIPTION OF THE PREFERRED EMBODIMENT

Figure 1:
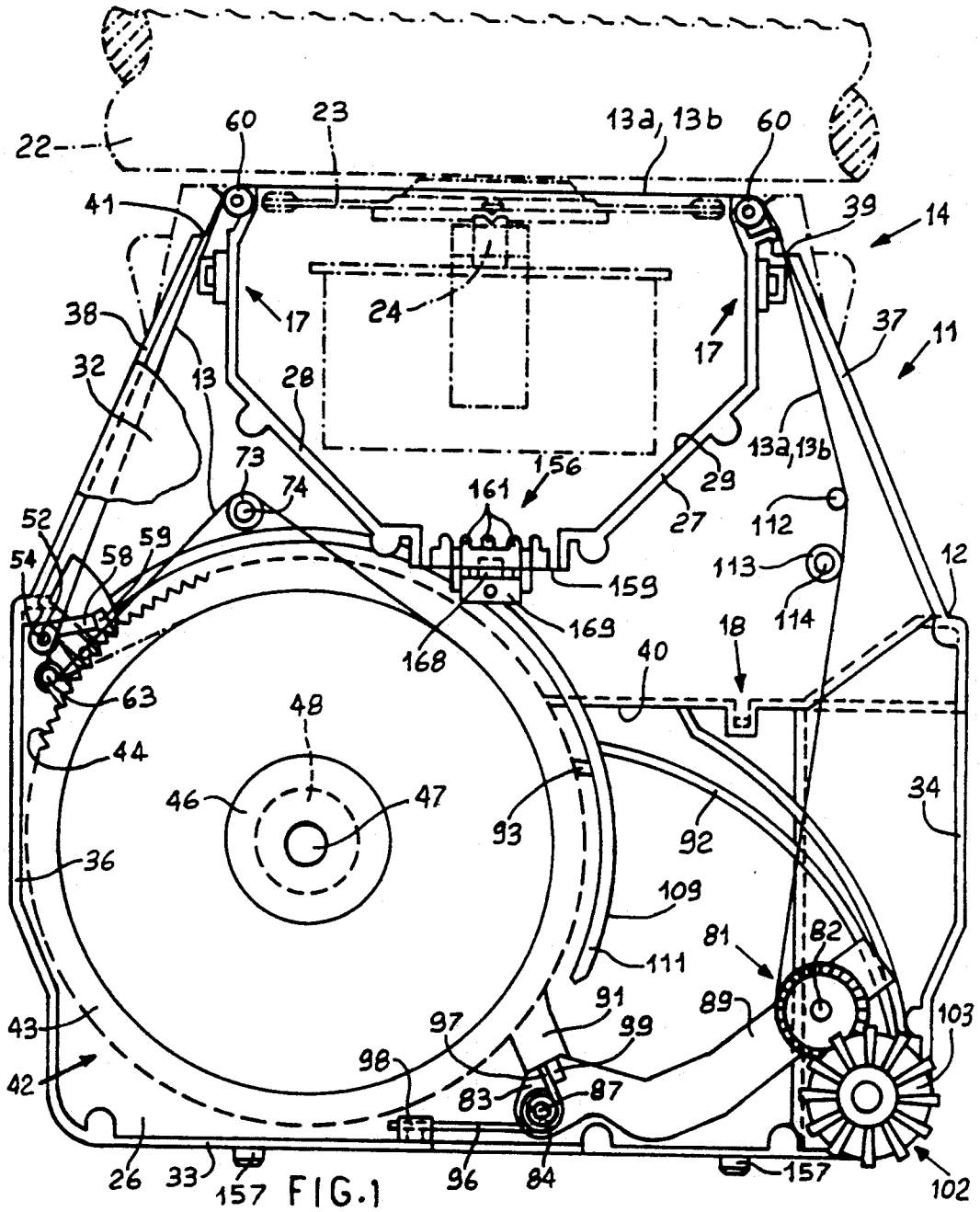
FIG. 1 is a plan view of part of a cartridge according to the invention.

Referring to FIGS. 1, 4, 5 and 6, a cartridge for a typing ribbon is generally indicated by reference numeral 11 and comprises a container 12 for accommodating a typing ribbon 13, 13*a* which may be of single-strike, correctable or non-correctable, carbon type, with a support of polyethylene, and of multi -strike type with a support of nylon, as indicated at 13*b*, and of inked type 13*c* with a fabric support.

A cartridge for a correction ribbon is generally indicated by 14 and can accommodate a correction ribbon 16 which may be of the lift-off cancellation type which is suited to the typing ribbon of correctable type, and of the cover-up correction type which is suitable for the typing ribbon of the non-correctable type of the various types of polyethylene, nylon or fabric. The correction cartridge 14 can be removably fixed to the lower part of the container 12 by engagement means indicated generally at 17. Coupling means which are generally indicated at 18 prevent the engagement means 17 from working when the ribbons are not compatible with each other. Fixing means which are generally indicated at 19 removably fix the container 12 on a support 21 of the typewriter either individually or in conjunction with the correction cartridge 14. The engagement means 17, the coupling means 18, the fixing means 19 and the correction cartridge 14 have been described and illustrated in diagrammatic and highly simplified form in order not to complicate the description and drawings, but they are substantially similar to those described in Italian patent application No 67132-A/88 filed on 22nd February 1988 in the name of the present applicants and which is therefore incorporated into this description.

The cartridge 11 (see FIG. 1) is mounted on a typewriter, for example an electronic typewriter, comprising a conventional platen roller 22, a character-carrying disc 23 and a striker 24. The roller 22, the disc 23 and the striker 24 are known per se and have been described and illustrated in diagrammatic and highly simplified form in order not to complicate the description and drawings. The cartridge 11 comprises the container 12 of plastics material having a bottom 26 and two rear walls 27 and 28 for rearwardly defining a space 29 for accommodating the character-carrying disc 23 and the striker 24, which are disposed in front of the platen roller 22 which defines a point of typing 31 (see FIG. 5). The container 12 (see FIG. 1) is closed upwardly by a substantially flat cover 32 and is defined by a front wall 33 and side walls 34 and 36. The container 12 comprises two arms 37 and 38 which project from the rear walls 27 and 28 and have two openings 39 and 41 respectively to permit the typing ribbon 13 to pass therethrough. The bottom 26 is provided with a step 40 which is parallel to the wall 33 and equidistant between the ends of the arms and the wall 33, which defines with the cover 32 a volume of a thickness which is slightly greater than the height of the ribbon at the arms 37 and 38 and a volume which is much greater in the region between the step 40 and the wall 33.

The container 12 (see FIGS. 1 and 2) is capable of accommodating a supply reel for the ribbon 13*a*, 13*b*, as indicated generally at 42, which in the lower part has a flange 43 provided on the outside edge with a compact tooth arrangement 44 which is uniformly distributed over the whole of its outside edge, and a tubular portion 46 which is fixed with respect to and integral with the flange 43, being rotatable on a pin 47 on the bottom 26. The tubular portion 46 comprises a hub 48 which projects downwardly beyond the flange 43 and which is normally supported on a shoulder 49 on the bottom 26, concentric to the pin 47, in the region of increased thickness of the container 12.

A tensioning and stop device comprises a lost-motion mechanism which is generally indicated by 51 and which comprises a stop lever 52 and a tensioning lever 53. The stop lever 52 is pivoted on a pin 54 on the bottom 26 adjacent to and outside the flange 43 and comprises a first arm 56 provided at the end with a bearing peg 57 and a second arm 58 provided at the end with a wedge-shaped stop element 59 capable of engaging without play into the spaces defined by the teeth 44 on the flange 43. The tensioning lever 53 is pivoted on a pin 61 on the bottom 26 adjacent to the pin 47 and comprises a first arm 62 having a side surface co-operable with the peg 57 on the stop lever 52 and being provided at the end with a guide pin 63 for engaging and guiding the typing ribbon 13*a* and 13*b* with a tensioning and loop take-up function.

The lever 53 further comprises a limb 64 which projects downwardly and which is opposite to the pin 63, being accommodated in a space 66 in the bottom 26 in order in use to actuate a signalling lever 67 of the machine such as to signal the end of the ribbon 13 which is wound on the supply reel 42. The tensioning lever 53 comprises a second arm 68 which is normally supported on a projecting guide 69 on the bottom 26 to guide the tensioning lever 53 during the rotary movement thereof. The projecting guide 69 is in the form of a sector of a circle and terminates with a shoulder 71 for arresting the second arm 68 after the signalling lever 67 has been actuated. The lever 53 with its pin 63 and the arm 56 of the lever 52 with its peg 57 are confined between the bottom 26 and the flange 43 in the volume of the container 12 which is of greater thickness.

The stop lever 52 and the tensioning lever 53 which are already of small dimensions are produced using materials which are of very low specific weights and they are thus of very limited inertia. A spring 72 is disposed between the second arm 58 of the stop lever 52 and the second arm 68 of the tensioning lever 53 in order to urge the arm 62 in an anticlockwise direction towards an end-of-travel position against the wall 36 and to urge the lever 52 in a clockwise direction for engagement of the wedge-shaped member 59 with the teeth 44.

The above-defined structure makes it readily possible to use ribbons 13*a* of small thickness, about 8 microns, in comparison with the normal value of about 14 microns, and large amounts of ribbon which are wound on the reel with substantial variations in respect of the reel from the full reel condition to the empty reel condition. In particular the spring 72 produces a low, predetermined tension which does not cause the ribbon 13*a* to stretch, while optimising tensioning of the typing ribbon 13 and engagement of the wedge-shaped element 59 with the spaces between the teeth 44.

The stop lever 52 is of plastics material and the tensioning lever 53 is of zamak.

Figure 2:
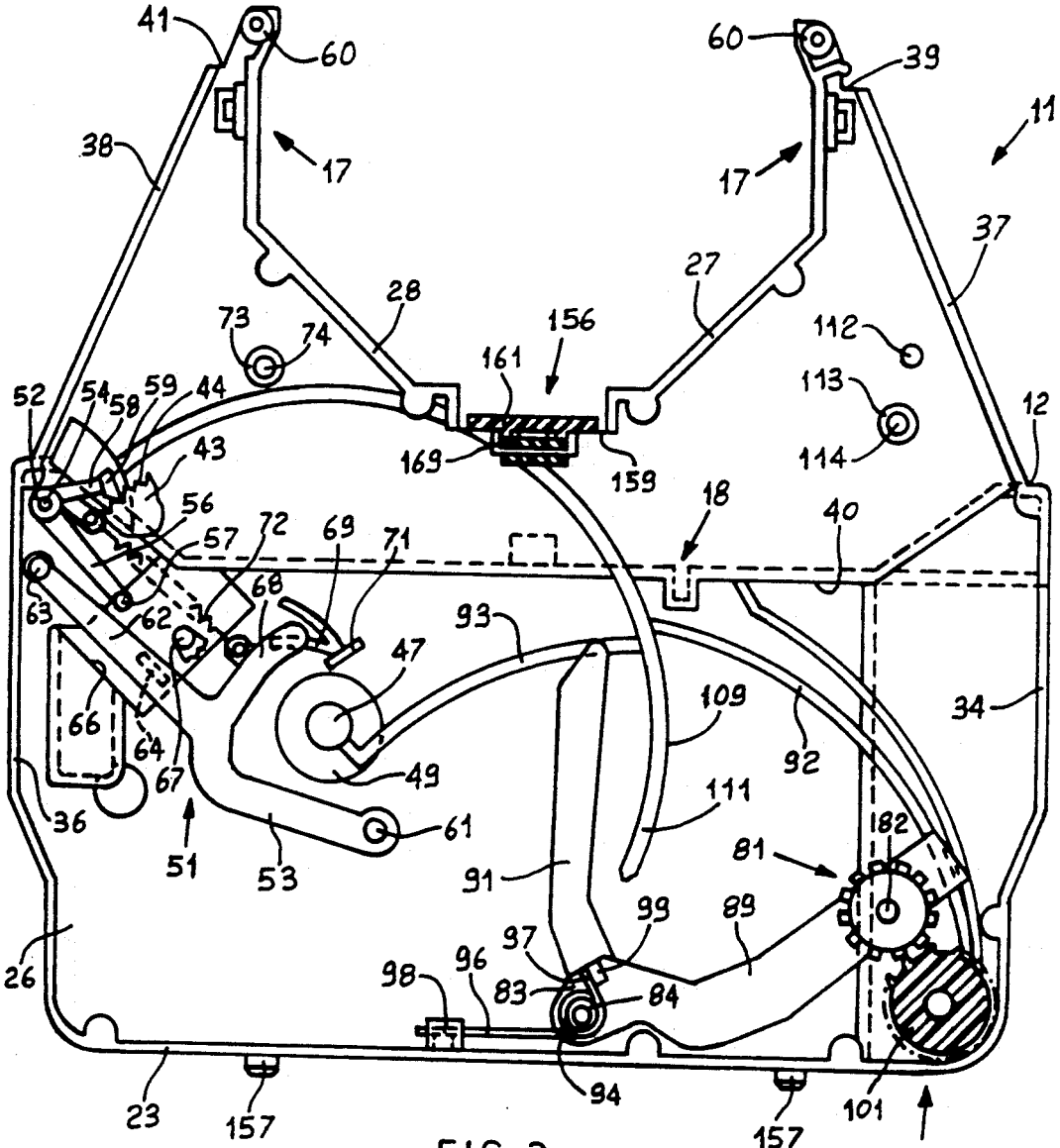
FIG. 2 is a plan view of part of a cartridge, shown in FIG. 1, illustrating some features thereof.
Figure 6:
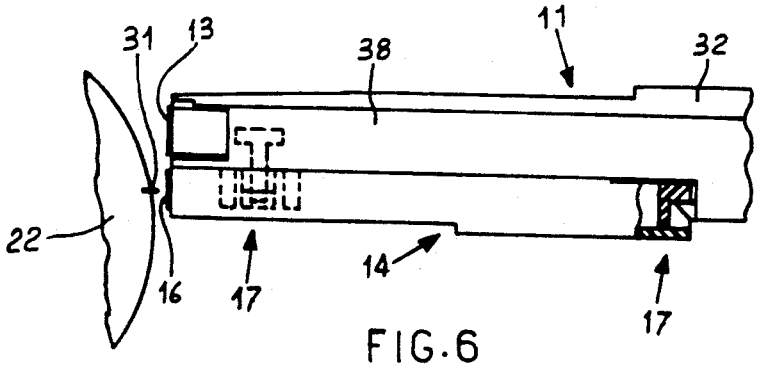
FIG. 6 is a side view of part of the cartridge shown in FIG. 1.

Both when the cartridge 11 has been removed from the machine and when it is fitted to the machine and the typing ribbon 13*a*, 13*b* is not caused to advance, as in quick tabulating movements, the tensioning and stop device 51 is in the position shown in FIGS. 1 and 2. The wedge-shaped element 59 is engaged without play in a space between the teeth 44 and the first arm 62 of the tensioning lever 53 is slightly spaced from the pin 57 on the stop lever 52 and permits an idle tensioning travel movement of the lever 53. The typing ribbon 13*a*, 13*b* which is unwound from the reel 42 is guided around the roller 73 and engages and is guided around the pin 63 of the tensioning lever 53 and subsequently issues from the opening 41 to extend parallel to the platen roller 22.

As the ribbon 13 is caused to advance, as described hereinafter, in anticipation of or after printing of a character, the tension in the ribbon 13 causes rotation in the clockwise direction of the tensioning lever 53 which after a short travel movement engages by means of its first arm 62 against the peg 57 in a zone which is aligned between the pins 54 and 61, and causes rotary movement in the anticlockwise direction of the stop lever 52 against the force of the spring 72. By rotating in the anticlockwise direction, the stop lever 52 disengages the wedge-shaped element 59 from the teeth 44. The supply reel 42 can thus rotate in the anticlockwise direction and permits the ribbon 13 to be unwound from the supply reel 42. Even when the typing ribbon 13 is moved with a continuous movement, the tension of the spring 72 causes the levers 52 and 53 to perform an intermittent movement in the anticlockwise direction and in the clockwise direction, over short distances, to keep the ribbon 13 tensioned in front of the point of the point of typing, with a feed movement with a strictly constant stepping motion. As the ribbon 13 ceases to advance, the tension of the spring 72 removes from the reel 42 that amount of ribbon which is sufficient to move the tensioning and stop device 51 into the rest condition, with the wedge-shaped element 59 engaged into a space between the teeth 44 and with the ribbon 13 properly tensioned. To improve the movement of the ribbon 13*a*, 13*b*, the ribbon additionally bears against rollers 60 which are supported rotatably by the arms 37 and 38 adjacent the openings 39 and 41.

Figure 12:
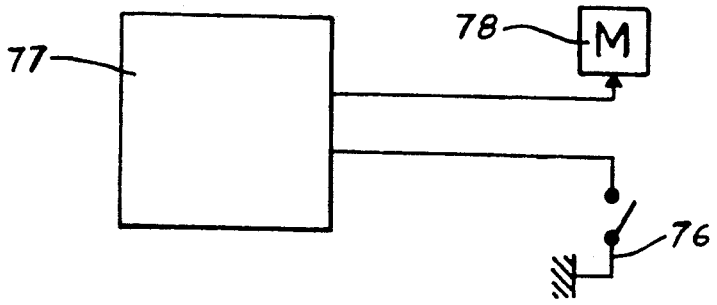
FIG. 12 is a logic diagram of the electronic control system for the cartridge according to the invention.

When the ribbon 13 has been completely unwound from the supply reel 42, the tension in the ribbon, the end of which is fixed to the hub 46, causes the tensioning lever 53 to rotate in a clockwise direction into an over-travel position in which the limb 64 engages the signalling lever 67, causing it to rotate until it actuates a switch 76 (see FIG. 12), thereby signalling an end-of-ribbon condition to an electronic control unit 77 of the machine. The electronic control unit 77 then causes the motor 78 to stop, and thus terminates the unidirectional feed movement of the typing ribbon 13.

The container 12 (see FIGS. 1, 2, 3 and 5) is also capable of accommodating a receiving reel which is generally indicated at 81 and which is rotatable on a pin 82 on a support lever 83. The lever 83 has a sleeve portion at 84 rotatable on a pin 86 on the bottom 26 and on a peg 87 on the cover 32, which is coaxial with the pin 86, in the region of the container 12 which is of greater height. The lever 83 comprises a first arm 89 from which the pin 82 projects and a second arm 91 which is disposed at approximately 90° from the first arm 89. The lever 83 is supported and guided by means of the two arms 89 and 91 on two corresponding guide ribs 92 and 93 which are in the shape of sectors of a circle and which project from the bottom 26, for translatory movement parallel to the bottom 26, as the turns of the ribbon 13 which are wound on to the receiving reel 81 increase, against the action of resilient means 94.

The resilient means 94 comprise a wire spring having a series of turns which are concentric with the sleeve 84 and which terminate with two arms 96 and 97 which are respectively arranged to engage a shoulder 98 on the container 12 and a shoulder 99 on the lever 83, to hold the lever 83 always in a condition of being rotated in the clockwise direction, with the receiving reel 81 engaged with a wheel 101 having straight teeth, of a feed roller assembly as indicated at 102.

Figure 5:
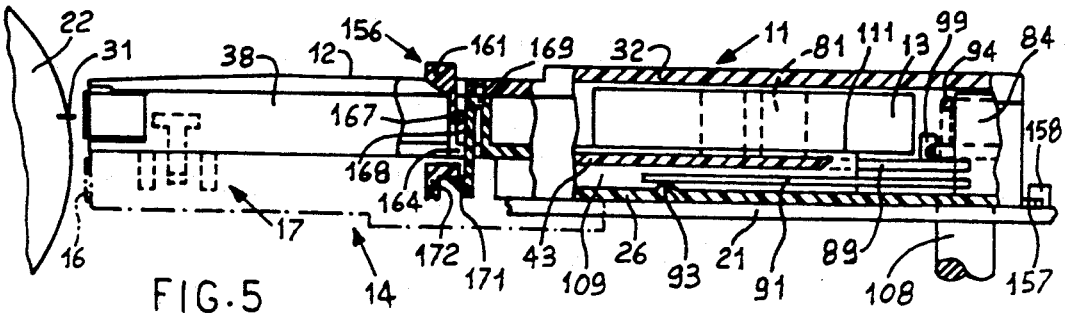
FIG. 5 is a side view of part of the FIG. 3 cartridge, showing features thereof, in an operating position.

The feed roller 102 comprises a small notched wheel 103 which partially projects from the cover 32 for manual feed movement of the ribbon 13, the toothed wheel 101 capable of co-operating with the ribbon 13*a* which is wound on to the receiving reel 81 in order to wind the ribbon 13 thereonto, a wheel 104 with sawtooth-shaped teeth, capable of co-operating resiliently with a stop element 106 fixed on the bottom 26 to prevent reverse motion of the roller 102, and a coupling arrangement 107 (see FIG. 9) which can be coupled to a drive shaft or spindle 108 (see FIG. 5). The drive shaft 108, the coupling arrangement 107 and the support 21 are described and illustrated in diagrammatic and highly simplified form in order not to complicate the description and drawings, but they are substantially similar to those described in U.S. Pat. No. 4,637,744 which is therefore incorporated into this description. The drive shaft 108 is driven in rotation by constant increments by the motor 78 (see FIG. 12) which in turn is controlled by the electronic control unit 77 of the machine and causes unidirectional feed movement of the ribbon 13.

The container 12 (see FIGS. 1, 2, 3 and 5) comprises a protective rib 109 which projects inwardly of the bottom 26 and which is positioned adjacent to the periphery of the flange 43, and its upper edge is in the same plane as the upper surface of the arm 89 and the lower edge of the turns of the ribbon 13 which are wound on the receiving reel 81. Therefore, as the turns of the ribbon 13 which is wound on the receiving reel 81 increase, said turns are supported against the upper edge 111 of the rib 109, thus avoiding any contact with the teeth 44 of the supply reel 42.

Figure 3:
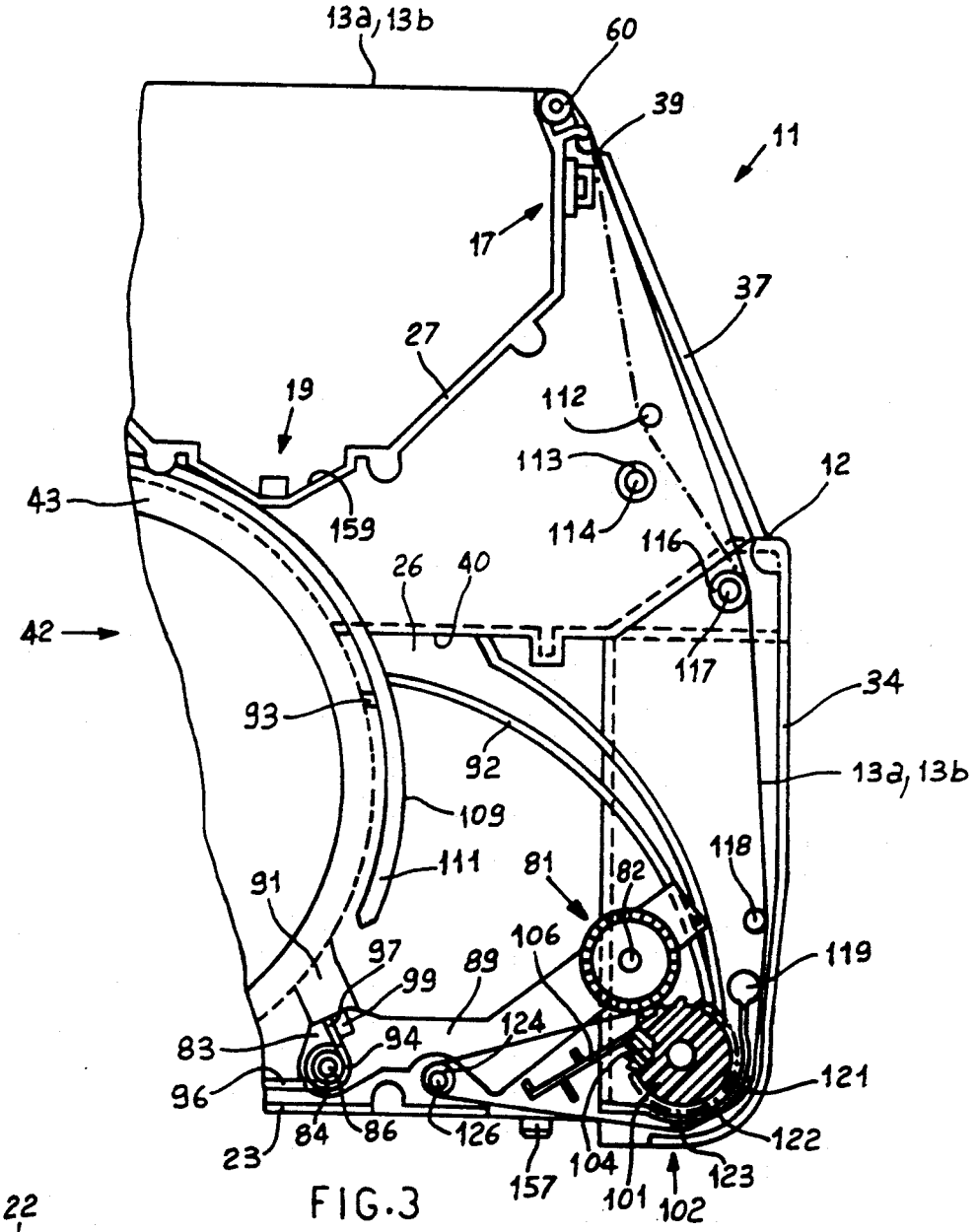
FIG. 3 is a plan view of a first alternative embodiment of the cartridge shown in FIG. 1, illustrating some features thereof.
Figure 4:
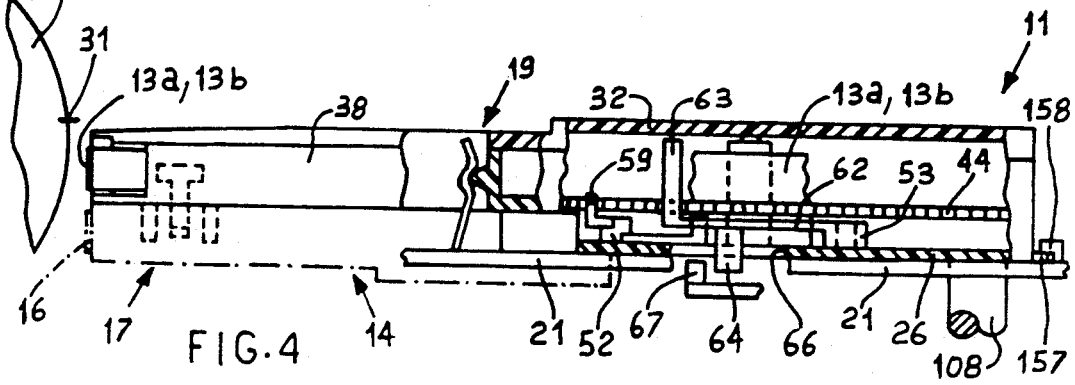
FIG. 4 is a side view of part of the FIG. 2 cartridge, showing some features thereof.
Figure 7:
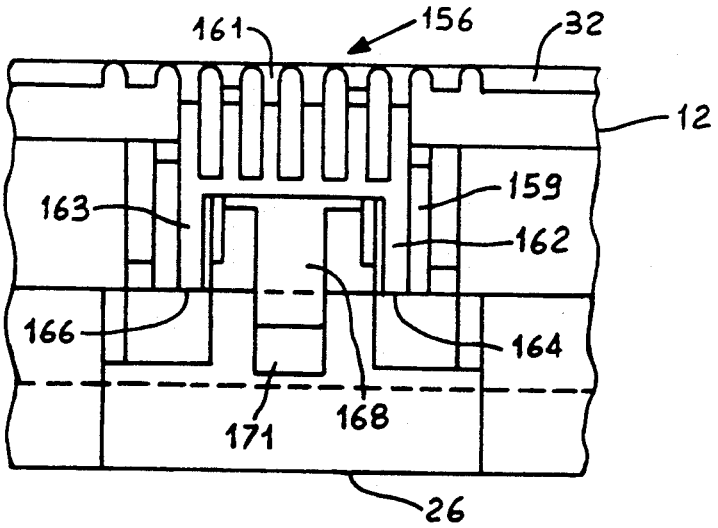
FIG. 7 is a front view of part of the FIG. 5 cartridge showing some features thereof, on an enlarged scale.
Figure 8:
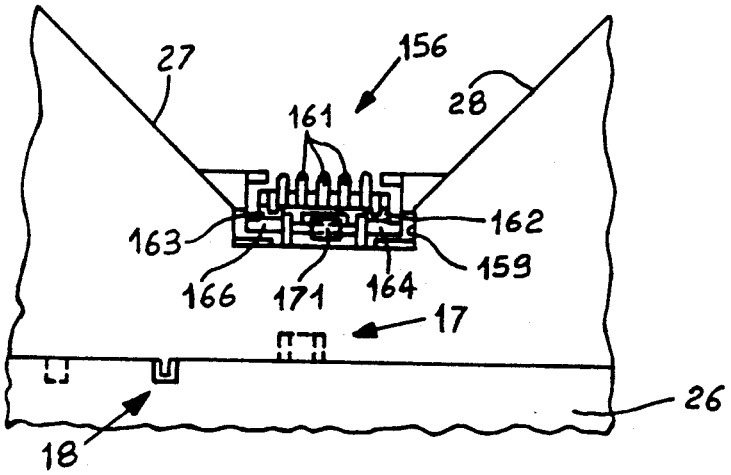
FIG. 8 is a plan view of part of the FIG. 5 cartridge, seen from below, showing some features thereof.

The typing ribbon 13*a*, 13*b* (FIG. 1) is unwound from the supply reel 42, guided around the roller 73, engages with and is guided around the pin 63 on the tensioning lever 53, issues from the opening 41 and, guided by the rollers 60, is disposed parallel to the platen roller 22. The ribbon 13*a*, 13*b* then re-enters through the opening 39, is guided firstly around the fixed pin 112 and then around a roller 113 which is rotatable on a pin 114 and is then engaged with and wound on to the receiving reel 81. In the alternative embodiment shown in FIGS. 3 and 9, the ribbon which re-enters the cartridge through the opening 39 is guided around a roller 116 which is rotatable on a pin 117 and then around two fixed pins 118 and 119. From there the ribbon is passed forwardly to the roller 101 by way of a column portion 121, a rib 122, a second fixed column portion 123 and a roller 124 which is rotatable on a pin 126 and is thus re-wound on to the receiving reel 81. In FIG. 3 the dash-dotted line indicates an alternative path of movement of the ribbon 13, in comparison with those described above.

Figure 9:
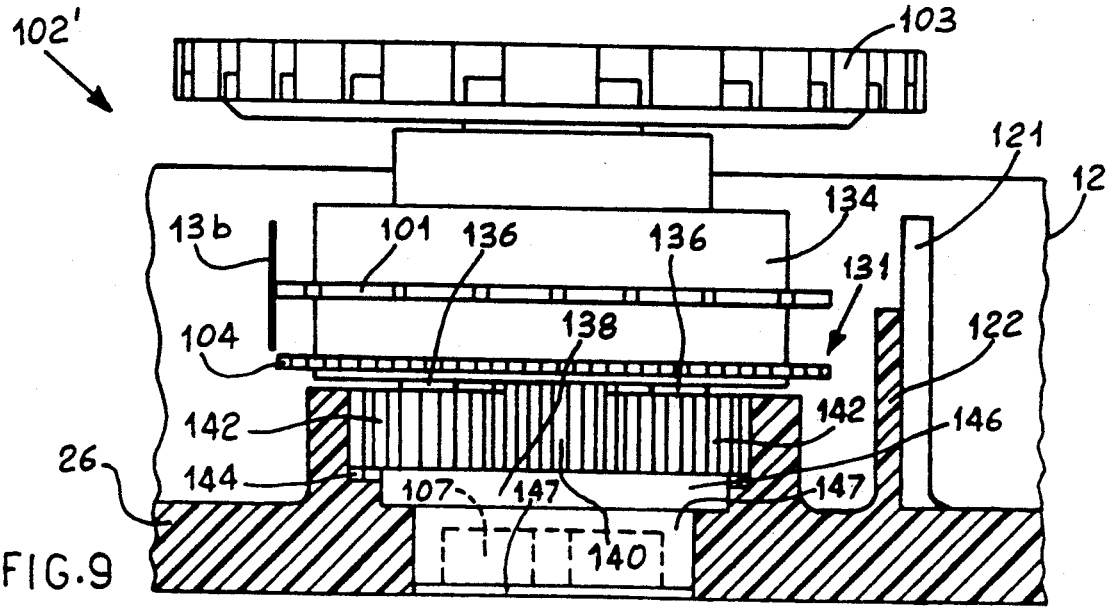
FIG. 9 is a side view of part of the FIG. 3 cartridge, showing some features thereof, on an enlarged scale.
Figure 10:
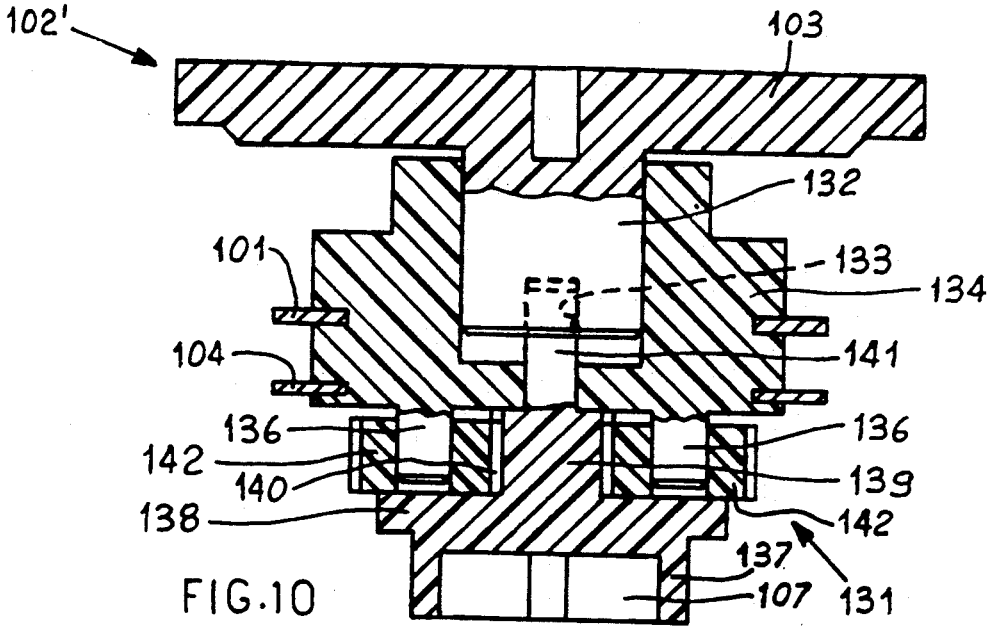
FIG. 10 is a diagrammatic view in section of details from FIG. 9.
Figure 11:
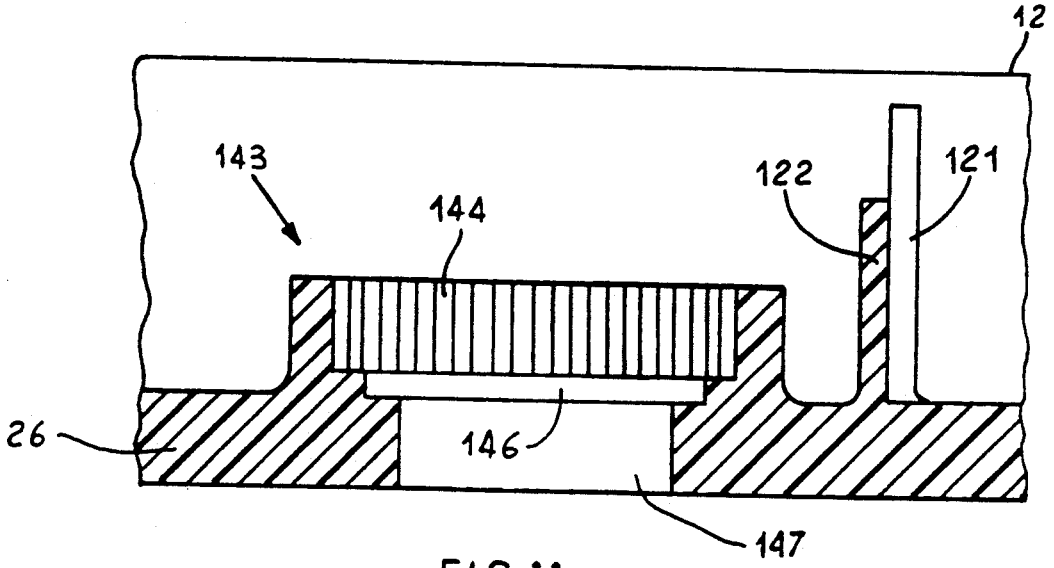
FIG. 11 is a view in section of other features from FIG. 9.

In the above-described cartridges 11 (see FIGS. 1, 2 and 3) which use a single-strike typing ribbon 13*a* of erasable or correctable type and of single-strike non-erasable type, with a polyethylene support, the unidirectional feed movement of the ribbon 13 is produced by means of direct coupling of the roller assembly 102 to the drive shaft 108. The rotational increments of the shaft 108 produce a movement of the ribbon 13 after printing of the characters, which is a little greater than the width of the character. Since however the multi-strike ribbon 13*b* permits a plurality of characters to be struck on the same part of the ribbon, the feed movement roller assembly which is suited for the multi-strike ribbon with a nylon support as generally indicated at 102' in FIGS. 9, 10 and 11 is of a structure which is different from that for the single-strike ribbon and besides the notched wheel 103 and the coupling arrangement 107 which are synchronous with the shaft 108, further comprises a speed reducing mechanism which is generally indicated at 131 for substantially reducing the turns of the toothed wheels 101 and 104 relative to the turns of the drive shaft 108 and the coupling arrangement 107.

In the assembly 102', the notched wheel 103 comprises a hub 132 having an internal seat 133. The wheel 101 with the straight teeth and the wheel 104 with the sawtooth-shaped teeth are fixed on a sleeve 134 which is rotatable on the hub 132 and comprises two pin portions 136 which project downwardly and in opposite relationship to the wheel 103. The coupling arrangement 107 is received internally of a tubular portion 137 which comprises a cylindrical flange 138 and a shaft portion 139 projecting from the flange 138 and having a first toothed portion so as to define a pinion 140 and a second cylindrical portion 141 which is capable of being press-fitted into the internal seat 133 in the hub 132. The reducing mechanism 131 comprises two toothed wheels 142 which are rotatable on the pin portions 136 and which are always in mesh with the pinion 140. A seat 143 in the bottom 26 of the container 12 comprises a toothed ring 144 which is always engaged with the toothed wheels 142 which are rotatable on the pin portions 136 and which are thus accommodated between the upper part of the cylindrical flange 138 and the lower part of the sleeve 134. The seat 143 comprises two cylindrical, coaxial openings 146 and 147 which are provided below the toothed ring 144, for respectively accommodating the cylindrical flange 138 and the tubular portion 137 to guide the roller assembly 102'.

The reducing mechanism 131 constitutes an epicyclic gear train in which the pinion 140 constitutes the sun gear, the toothed wheels 142 constitutes the planet gears, and the toothed ring 144 constitutes the ring gear, the mechanism being capable of reducing the turns of the toothed wheel 101 with respect to the turns of the drive shaft 108 in dependence on the transmission ratio between the number of teeth on the pinion 140 and the number of teeth on the toothed ring 144. In order to optimise use of the multi-strike typing ribbon **13*b*, the ratio between the turns of the drive shaft 108 and the turns of the toothed wheel 101 is 4.8:1, that is to say the drive shaft 108 performs 4.8 revolutions while the toothed wheel 101 performs one revolution. That is achieved with a pinion 140 having 8–10 teeth, which makes it possible to have a toothed roller assembly 102. As already referred to and described above, by varying the transmission ratio the value of the ratio 4.8:1 is also varied. In addition as is clearly visible from the drawings the reducing mechanism 131 does not interfere with the path of movement of the ribbon 13*b*, or with the ribbon 13*b* which is being wound on to the receiving reel 81** again.

In order further to simplify the above-described cartridge, all the containers 12 provide the seat 143 having the toothed ring 144. At the time of assembly containers 12 which are intended to accommodate typing ribbons **13*a* of correctable and non-correctable type, of polyethylene, are assembled with the roller 102 while containers 12 which are intended to accommodate typing ribbons 13*b* of multi-strike non-correctable type of nylon are assembled with the roller 102' having the reducing arrangement 131**.

The cartridge 11 may be removably fixed to the support 21 (see FIG. 4) by the fixing means 19 or by means of a travel-amplifying arrangement as indicated generally at 156 (see FIGS. 1, 2, 5, 7, 8 and 13).

Two lugs 157 project from the front wall 33 of the container 12 and capable of engaging in respective hook portions 158 on the support 21. The arrangement 156 is disposed on an intermediate wall 159 between the arms 37 and 38 and comprises an upper element 161 capable of being manually engaged for actuation purposes, being provided at its end with two flexible lateral blade portions 162 and 163 which connect the upper element 161, by means of two lower edges 164 and 166, to a lower part of the intermediate wall 159. An intermediate projection 167 on the upper element 161 engages a resilient blade portion 168 which is positioned between the flexible side blade portions 162 and 163. The resilient blade portion 168 has its upper end integral with an upwardly projecting edge 169 of the intermediate wall 159 and the lower end 171 in the form of a hook configuration for engagement with a fixed shoulder 172 on the support 21. With a small movement of the upper element 161, the travel-amplifying arrangement 156 produces a corresponding large movement of the hook portion 171, thus making it easier to fit the container 12 to and remove it from the support 21.

Figure 13:
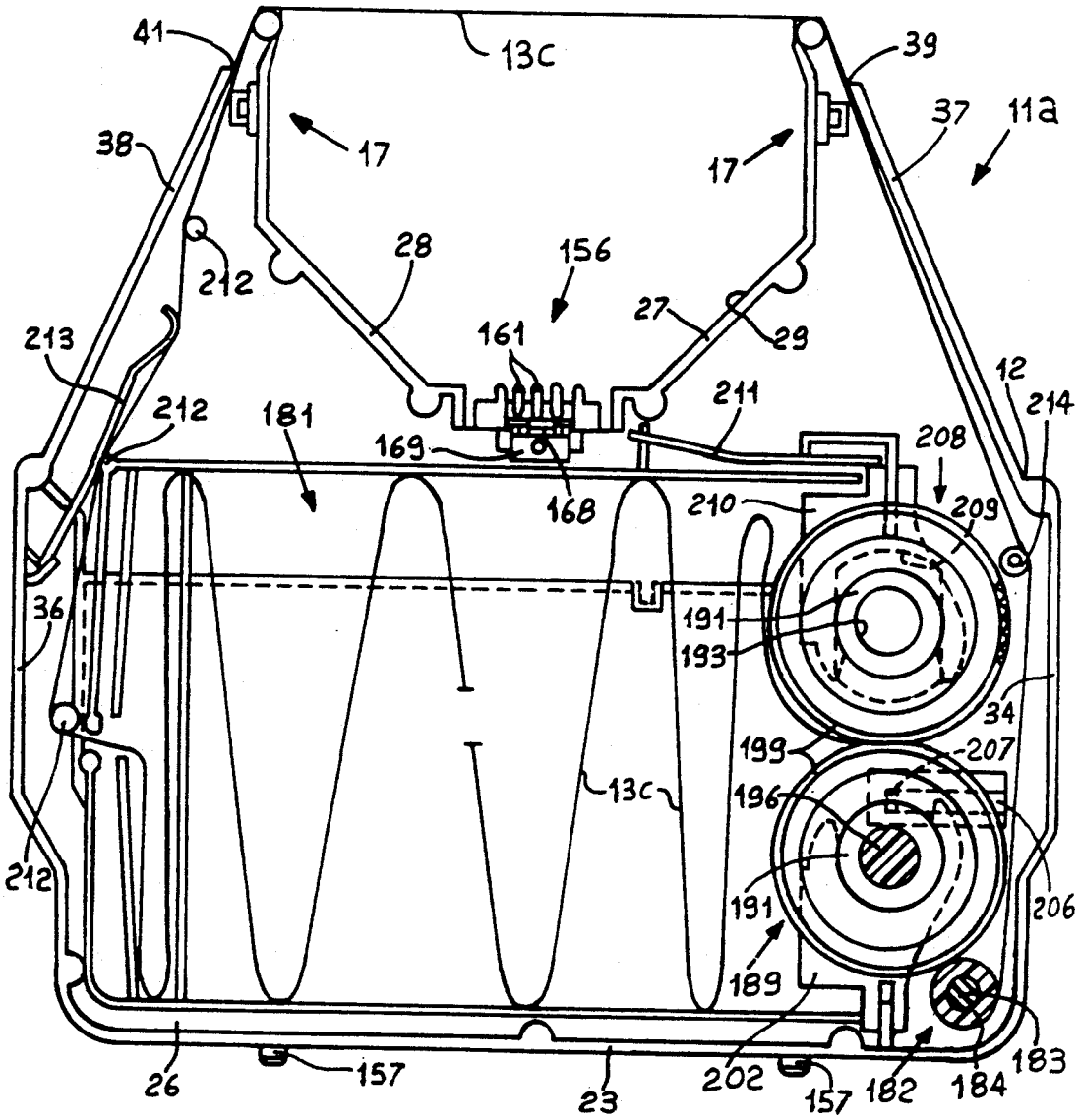
FIG. 13 is a plan view of part of a second alternative embodiment of the cartridge shown in FIG. 1.
Figure 15:
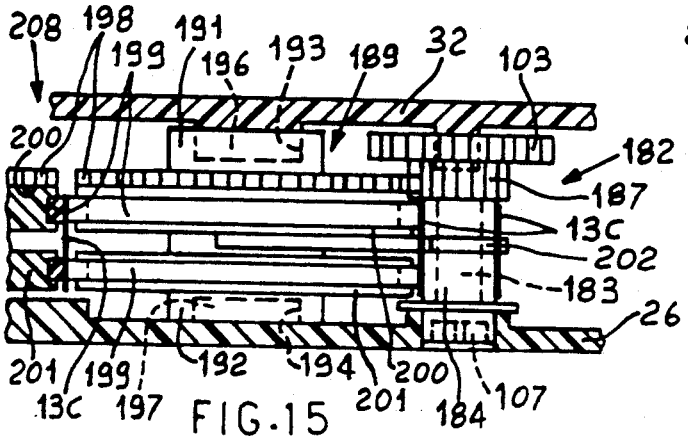
FIG. 15 is a side view of some features from FIG. 13, on an enlarged scale.
Figure 14:
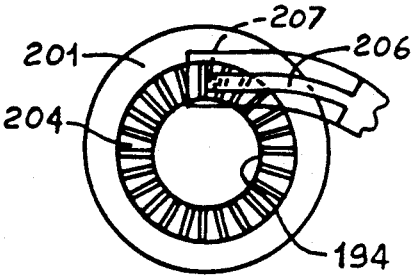
FIG. 14 is a plan view of part of the FIG. 13 cartridge, showing further features thereof, seen from below.

FIGS. 13, 14 and 15 concern a cartridge **11*a* which can accommodate an inked typing ribbon 13*c* of the fabric type. The cartridge 11*a* has portions for interfacing with the typewriter which are the same as those of the cartridge 11 described hereinbefore and which are denoted by the same reference numerals. The container 12 comprises a magazine 181 of constant height for accommodating the inked ribbon 13*c*** which is of the closed loop type disposed in randomly distributed turns.

A feed roller 182 is rotatable in the container 12 and comprises a shaft portion 183 which can be coupled by way of the coupling arrangement 107 to the drive shaft 108, and the notched wheel 103, and a toothed wheel 187 which is fixed on the shaft portion 183 and a sleeve 184 which is freely rotatable about the shaft portion 183.

A feed wheel 189 comprises at its ends two hubs 191 and 192 which are rotatable on pins 196 and 197 of the container 12, a toothed ring 198 engaged with the toothed wheel 187, and two elastic rings 199 mounted on two grooved flanges 200 and 201 for the feed movement of the ribbon **13*c*. The flange 201 is provided in its lower part with a radial tooth arrangement 204. A resilient blade portion 206 provided by the bottom 26 has a tooth 207 for engaging the tooth arrangement 204 to prevent reverse rotary movements of the wheel 189**.

A pressure wheel 208 which is substantially identical to the first wheel 189 is slidable by means of the hubs 191 and 192 in guides 209 on the cover 32 and the bottom 26, and a fixed separator 202 of the container 12 and a movable separator 210 are arranged to disengage the inked ribbon **13*c* from the rings 199. A blade spring 211 co-operates with the movable separator 210 to hold the pressure wheel 208 in constant contact with the feed wheel 189 in such a way that the ribbon 13 remains pinched between the rings 199**.

The inked ribbon **13*c* issues from the magazine 181, is guided around three fixed pins 212, co-operating with a tensioning spring 213, and issues from the opening 41. It passes in front of the platen roller 22 (see FIG. 1), returns into the cartridge through the opening 39 (see FIGS. 13 and 15), is guided around a rotatable roller 214 and around the sleeve 184 and then, remaining in contact with the rings 199, is re-introduced into the magazine 181 by means of the wheels 189 and 208**.

It will be appreciated that modifications and improvements may be made in the cartridges 11 for the typing ribbon 13, both in regard to the form and the arrangement of the various elements and parts, without thereby departing from the scope of the present invention.

What we claim is:

1. A cartridge for a typing ribbon for typewriters comprising a container, a supply redel which is rotatable in the container and a device for tensioning and braking the ribbon comprising a flange on the supply reel provided with peripheral notches, a ribbon tensioning lever pivoted in the container and a stop element engageable selectively with the notches, a stop lever on which the stop element is fixed, and in which the stop lever is pivoted in the container to oscillate between an engagement position in which the stop element locks the supply reel and a disengagement position in which the stop element is disengaged from the notches; spring means which act on the stop lever to hold the stop element normally in engagement with the notches; and a lost-motion coupling between the tensioning lever and the stop lever to move the stop lever from the engagement position to the disengagement position after an idle travel movement of the tensioning lever alone and an operating travel movement of the tensioning lever and the stop lever, wherein the stop lever is pivoted on a fulcrum in the container adjacent to the notches, the tensioning lever is pivoted on a fulcrum, adjacent to the axis of rotation of the supply reel and at one end carries a guide element for the ribbon which is unwound from the supply reel, in which the lost-motion coupling comprises a first bearing portion for the stop lever and a co-operating second bearing portion for the tensioning lever, in which under rest conditions the first bearing portion is disengaged from the co-operating second bearing portion, thereby to define the idle travel movement of the tensioning lever and in which the first bearing portion and the co-operating second bearing portion are capable of coming into engagement in a zone substantially aligned between the fulcrum of the stop lever and the fulcrum of the tensioning lever, wherein the spring means comprises a single spring acting as a resilient connection between the tensioning lever and the stop lever, and wherein the stop lever comprises a pair of arms of which one arm carries the stop element and the other arm carries a peg portion which constitutes the first bearing portion, in which the tensioning lever comprises a first arm, to one end of which is fixed the ribbon guide element and having a side surface defining the co-operating second bearing portion, and in which the single spring is fixed between a projection on the stop lever and a projection on the tensioning lever.

2. A cartridge for a typing ribbon for typewriters of the type having a support and in which the cartridge is positioned on the support and comprises a container for accommodating a typing ribbon and having two projecting arms for positioning an external portion of the ribbon parallel to a platen roller, an intermediate wall positioned between said projecting arms, a front wall opposite to said intermediate wall, and engagement means for removably fixing the container on the support, wherein said engagement means comprise two lugs projecting from said front wall, two hook portions of the support for engaging said two lugs, a flexible limb projecting downwardly from an upper edge of the intermediate wall and having a lower hook capable of engaging with a fixed shoulder of the support and a travel amplifying arrangement operative on said limb, said travel amplifying arrangement comprising:

two flexible blade portions which project upwardly from a lower part of the intermediate wall at the sides and rearward to said flexible limb and which are provided in turn with an upper projection and an intermediate projection;

wherein said upper projection is capable of being manually engaged to flex said two blade portions and wherein said intermediate projection is positioned adjacent to said upper projection and is capable of engaging the flexible limb in a region adjacent to the upper edge of the intermediate wall to flex the flexible limb frontwardly in response to a frontwardly flexing of said flexible limb.

3. A cartridge for a typing ribbon for typewriters comprising a drive shaft for the unidirectional feed movement of the typing ribbon, and in which the cartridge comprises a container for accommodating a receiving reel for the typing ribbon, a feeding roller which can be coupled to the drive shaft and having a toothed wheel for the unidirectional feed movement of the typing ribbon, a support lever on which the receiving reel is rotatable and resilient means operative on the support lever to hold the most outward turns of the receiving reel in engagement with said feeding roller;

wherein the container comprises a bottom wall and a pin and guide ribs which project from the bottom wall, and a cover having a peg which is coaxial with said pin;

wherein said support lever comprises a sleeve portion rotatable on the pin portion and on the peg and having a first arm including at the end a pin on which is rotatable the receiving reel and a second arm disposed at approximately 90° from the first arm;

wherein said resilient means comprise a series of cylindrical turns concentric with the sleeve portion having a first end operative on said support lever and a second end arrested by said container; and wherein the ends of the first and second arms of said support lever are supported against and guided by the guide ribs, for translatory movement parallel to the bottom as the turns of the typing ribbon which are wound on to the receiving reel increase, against the action of the resilient means.

4. A cartridge according to claim 3, further comprising a supply reel for the typing ribbon rotatable on the container and having a flange provided on the outside edge with teeth, wherein the bottom wall comprises a protective rib which projects from the bottom, is in the shape of semicircle positioned adjacent to the periphery of the teeth and has an upper edge in the same plane as the upper part of the first arm of the support lever and the lower edges of the turns of the typing ribbon which are wound on the receiving reel, and wherein as the turns of the typing ribbon wound on the receiving reel increase, said turns are supported by said upper edge preventing any contact of these turns with said teeth, and wherein the second arm of the support lever is guided by the corresponding guide rib and is positioned between the flange and this guide rib.

5. A cartridge for a typing ribbon for typewriters of the type having a single drive shaft for the unidirectional feed movement of the ribbon, in which the cartridge comprises a container having a receiving reel for the ribbon rotatable and displaceable within the container, a feed roller, a coupling arrangement for rotatably coupling said feed roller to the drive shaft to rotate in a given direction for the unidirectional feed movement of the ribbon, a toothed wheel carried by the roller, resilient means urging the receiving reel in such a way that the outward turns of the ribbon are in engagement with the toothed wheel of the feed roller in order to wind the ribbon onto the receiving reel in response to the rotation of said roller in said given direction, and means for preventing rotary movement of the feed roller in a direction opposite to said given direction, said preventing means comprising:

a sawtooth wheel having sawtooth-shaped teeth and permanently rotatably coupled with said feed roller and said toothed wheel; and a stop element supported resiliently by the container adjacent to said sawtooth wheel and cooperative with said sawtooth-shaped teeth to prevent rotation of said feed roller in said direction opposite to said given direction.

6. A cartridge according to claim 5, in which the container has a bottom wall, said stop element is supported on the bottom wall, wherein said sawtooth wheel is bodily fixed to the toothed wheel and the coupling arrangement and wherein said sawtooth wheel is positioned between the toothed wheel and the coupling arrangement below a trajectory of the ribbon internally to said container.

7. A cartridge for a typing ribbon for typewriters of the type having a single drive shaft for the unidirectional feed movement of the ribbon, in which the cartridge comprises a container having a receiving reel for the ribbon rotatable and displaceable within the container, a feed roller, a coupling arrangement for rotatably coupling said feed roller to the drive shaft to rotate in a given direction for the unidirectional feed movement of the ribbon, a toothed wheel carried by the roller, resilient means urging the receiving reel in such a way that the outward turns of the ribbon are in engagement with the toothed wheel of the feed roller in order to wind the ribbon onto the receiving reel in response to the rotation of said roller in said given direction, and means for preventing rotary movement of the feed roller in a direction opposite to said given direction, said preventing means comprising:

a sawtooth wheel having sawtooth-shaped teeth and permanently rotatably coupled with said feed roller and said toothed wheel; and a stop element supported resiliently by the container adjacent to said sawtooth wheel and co-operative with said sawtooth-shaped teeth to prevent rotation of said feed roller in said direction opposite to said given direction, wherein said typing ribbon is of multi-strike type, and wherein said coupling arrangement comprises a driven shaft which is rotatable on the container and which is provided at a first terminal portion with a coupling member which can be coupled to the drive shaft to be rotated incrementally by the drive shaft, and an epicyclic transmission mechanism between the feed roller and the drive shaft, said transmission mechanism comprising as a sun gear, a pinion fixed to said driven shaft, as a ring gear, a toothed ring having internal teeth provided on a bottom wall of the container; and, as a planet gear, two toothed rollers which are rotatable on corresponding pins carried by the feed roller and in which said feed roller is rotatable about a portion of said driven shaft.

8. A cartridge according to claim 7, further comprising a wheel with notches fixed on the driven shaft, said wheel projecting at the top from the container for manual feed movement of the ribbon, and in which the sawtooth wheel is fixed to said feed roller.

9. A cartridge for a typing ribbon for typewriters comprising a container for accommodating a supply reel having a flange provided on the outside edge with a series of peripheral notches and a ribbon tensioning device comprising a tensioning lever pivoted in the container and having a guide element for guiding and tensioning the ribbon during the unidirectional feed movement thereof, a stop element capable of co-operating with the series of notches to prevent unwinding of the ribbon which is wound on the supply reel, and a spring applied to the tensioning lever for tensioning the ribbon when the reel is locked by the stop element.

a stop lever pivoted on the container and on which the stop element is fixed; and a first bearing element of the tensioning lever, capable of co-operating with the stop lever against the force of a spring applied to the stop lever to disengage the stop element from the notches in response to an operating travel movement of the tensioning lever, wherein the stop lever comprises a first arm from which projects a peg portion co-operable with the first bearing element of the tensioning lever and a second arm which terminates with the stop element, in which the spring also acts on the stop lever and in which the tensioning lever comprises:

a first arm constituting the first bearing element capable of co-operating with the peg portion; and a pin portion projecting from the first arm and constituting the guide element for the ribbon, with a take-up function during the unidirectional feed movement of the ribbon.

10. A cartridge according to claim 9, further comprising a second bearing element of the tensioning lever, capable of co-operating with a signalling lever of the machine to signal the end of the ribbon which is wound on the supply reel in an over-travel condition of the tensioning lever;

a limb projecting from the first arm but on the opposite side with respect to the pin portion and constituting the second bearing element and in which this limb is accommodated in a space in the bottom of the container to actuate the signalling lever in the over-travel condition of the tensioning lever; and a second arm, to which the spring is connected and by means of which the tensioning lever bears against and is guided on a guide projecting from the bottom of the container.

11. A cartridge according to claim 10, wherein the guide is in the form of a sector of a circle and terminates with a shoulder capable of arresting the second arm after the signalling lever has been actuated.

12. In a cartridge for a typing ribbon for typewriters comprising a container having a bottom wall; a supply reel which is rotatable in the container about an axis of rotation, and a device for tensioning and braking the ribbon comprising a flange on a lower portion of the supply reel provided with peripheral notches, a stop lever, a stop element engageable selectively with the notches and fixed on said stop lever, and in which the stop lever is pivoted in the container to oscillate between an engagement position in which the stop element locks the supply reel and a disengagement position in which the stop element is disengaged from the notches, spring means which act container and a lost-motion coupling between the tensioning lever and the stop lever to move the stop lever from the engagement position to the disengagement position after an idle travel movement of the tensioning lever along and an operating travel movement of the tensioning lever and the stop, lever, a first fulcrum in the container positioned adjacent to the notches, said stop lever being pivoted on said first fulcrum;

a second fulcrum in the container having an intermediate portion which is confined in a region of said container included between said flange and said bottom wall and an end portion adjacent to and outside said notches and in which said end portion carries a guide element for the ribbon which is unwound from the supply reel said tensioning lever being pivoted on said second fulcrum, said second fulcrum being positioned adjacent to the axis of rotation of said supply reel, and said intermediate portion being positioned between said second fulcrum and said end position;

said lost-motion coupling comprises a first bearing portion of the stop lever and a co-operating second bearing portion of the tensioning lever, the first bearing portion being disengaged from the co-operating second bearing portion underrest conditions, to define the idle travel movement of the tensioning lever;

said spring means comprises a single spring acting as a resilient connection between the tensioning lever and the stop lever, and confined in the region of said container included between said flange and said bottom wall;

said stop lever comprises an end carrying the first bearing portion, in which said end carrying the first bearing portion is confined in the region of said container included between said flange and said bottom wall, in which said intermediate portion comprises a bearing surface defining said co-operating second bearing portion and in which the first bearing portion and the co-operating second bearing portion are capable of coming into engagement in the region of said container included between said flange and said bottom wall.

13. A cartridge according to claim 12, for a machine comprising a signalling lever to signal the end of the ribbon which is wound on the supply reel, wherein said bottom wall comprises an opening and wherein said tensioning lever comprises a lug which projects from said intermediate portion between said bearing surface and said fulcrum on the opposite side with respect to the guide element, and is accommodated in the opening for co-operating with said signalling lever to signal the end of the ribbon in an over-travel condition of the tensioning lever.

14. A cartridge according to claim 12, wherein the end of said stop element and the first bearing portion of the tensioning lever are capable of coming into engagement in a zone substantially aligned between the first fulcrum of said stop lever and the second fulcrum of said tensioning lever.

15. A cartridge according to claim 12 for a typewriter comprising a drive pin for the unidirectional feed movement of the ribbon, and in which said container further accommodates a receiving reel for the ribbon devoid of flange, a roller which can be coupled to the drive pin for the feed movement of the ribbon and having a toothed wheel projecting upwardly from the container for the unidirectional feed movement of the ribbon, a support lever pivoted in the container and on which the receiving reel is rotatable, and resilient means which act on the support lever to hold the most outward turns of ribbon which are wound onto the receiving reel in engagement with the toothed wheel; wherein the support lever comprises a first arm having a pin portion on which the receiving reel is rotatable and a second arm disposed at about 90° with respect to the first arm, in which said support lever is supported on and guided by a corresponding guide rib projecting from said bottom wall for translatory movement parallel to said bottom wall against the force of the resilient means and without impediment as the turns of the ribbon which is wound on the receiving reel increase; and wherein a protective rib projects from said bottom wall adjacent to the periphery of the flange and has an upper edge in the same plane as an upper part of the first arm of said support lever for guiding the turns of the ribbon which is wound on the receiving reel in order to prevent any contact of those turns with the peripheral notches of said flange.

* * * * *